US007624831B2

(12) United States Patent
Orr et al.

(10) Patent No.: US 7,624,831 B2
(45) Date of Patent: Dec. 1, 2009

(54) METHOD AND APPARATUS FOR MOVING IN FORMATION THE MODULAR COMPONENTS OF A DRILLING RIG FROM WELL TO WELL

(75) Inventors: Melvin Alan Orr, Tulsa, OK (US); Mark Trevithick, Houston, TX (US); Christopher Alan Major, Tulsa, OK (US); Robert Lee Stauder, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 370 days.

(21) Appl. No.: 11/773,318

(22) Filed: Jul. 3, 2007

(65) Prior Publication Data

US 2009/0008112 A1 Jan. 8, 2009

(51) Int. Cl.
*B60T 7/16* (2006.01)

(52) U.S. Cl. ..... 180/167; 180/169; 180/204; 180/305; 180/306; 173/184; 173/28

(58) Field of Classification Search ..... 180/167, 180/169, 204, 305, 306; 173/184, 28
See application file for complete search history.

(56) References Cited

U.S. PATENT DOCUMENTS 4,899,832 A * 2/1990 Bierscheid, Jr. ..... 173/187
5,109,934 A * 5/1992 Mochizuki ..... 175/170
5,248,005 A * 9/1993 Mochizuki ..... 175/85
6,032,097 A * 2/2000 Iihoshi et al. ..... 701/96
6,848,515 B2 2/2005 Orr
6,860,337 B1 3/2005 Orr

OTHER PUBLICATIONS http://www.doyondrilling.com/rig15.html, retrieved Sep. 28, 2007.
http://www.doyondrilling.com/rig15_enlarged.html, retrieved Sep. 28, 2007.
http://www.doyondrilling.com/rig19.html, retrieved Sep. 28, 2007.
http://www.doyondrilling.com/rig19_enlarged.html, retrieved Sep. 28, 2007.
National-Oilwell 1998-1999 Composite Catalogs, pp. 555-559.

* cited by examiner

*Primary Examiner*—Paul N Dickson
*Assistant Examiner*—Bryan A Evans
(74) *Attorney, Agent, or Firm*—Akin Gump Strauss Hauer & Feld LLP

(57) ABSTRACT

A method and apparatus to move a modular drilling rig in formation wherein the drilling rig includes a plurality of self-propelled modules to facilitate the movement of the rig while all systems are intact and fully operational. The apparatus includes a plurality of wheel assemblies which are steerable to guide the modules during movement. The apparatus also includes a propulsion system for each of the modules to drive each of the modules during movement. A steering control and position feedback system is also provided for determining the relative position of each module with respect to the master module. This control and feedback system provides feedback to the steering control and feedback systems of other modules in order to move the modules in a formation.

18 Claims, 6 Drawing Sheets

METHOD AND APPARATUS FOR MOVING IN FORMATION THE MODULAR COMPONENTS OF A DRILLING RIG FROM WELL TO WELL

CROSS-REFERENCE TO RELATED APPLICATIONS

N/A

STATEMENTS REGARDING FEDERALLY SPONSORED RESEARCH OR DEVELOPMENT

N/A

REFERENCE TO A MICROFICHE APPENDIX

N/A

BACKGROUND OF THE INVENTION

1. Field of the Invention

The field of the invention relates to drilling rigs for the drilling of oil, gas and other wells, and in particular to drilling rigs having modular components which are capable of being moved from well to well in formation.

2. Description of the Related Art

In drilling oil and gas wells, it is well known that almost innumerable components are essential to actually drilling the well. For example, a basic drilling rig structure having a mast housing rotational equipment such as a top drive is necessary to direct the drill pipe and casing strings into the borehole as drilling takes place. In order to circulate the drill cuttings out of the borehole during drilling, it is necessary to circulate drilling "mud" or fluid down the drill pipe and upwardly through the annulus between the drill pipe and the casing. Providing the mud circulation system requires powerful mud pumps, fluid storage equipment, and particle separation equipment to remove the drill cuttings and prepare the drilling mud for recirculation.

The top drive and most other well equipment are electrically powered, thus requiring significant power generation equipment. For example, referring to FIG. 2 of U.S. Pat. No. 4,899,832, the drilling unit includes massive pipe storage units, a mud mixing and supply unit, first and second electrical power supply units, a drilling mud return unit, a fuel unit, a water supply unit, a cement unit and a command center, which must be set up at each drill site, and then transported on truck tractors to the next well site and then set up again in the necessary arrangement for drilling activity. Typically in the U.S., such equipment must be broken down into loads which meet allowable weight and size restrictions for travel along state and federal roads.

In some foreign countries where the drilling sites are located on remote land such as in the Artic or in the deserts of the Mid-East, because the drilling rigs and associated equipment do not have to travel along highways, it is known to use portable drilling rigs in which the drilling equipment is housed in travel modules. For example, Dreco, now a part of National Oil Well Varco, utilized modular type construction of the drilling rig and drilling equipment such that the modules could be disassembled and loaded onto trucks, islands, barges, and/or caissons for travel between well sites. The Dreco portable rigs utilized giant wheel assemblies, which included all wheel drive, to move the rigs over the country side, but insofar as known, the modular components were moved without attempt to maintain the modules in drilling formation or arrangement during travel. For example, Dreco's Desert Rigs were moved from well to well in a single line formation using a combination of truck tractor and wheel units mounted directly with the drilling modules. Once a new drill site was reached, while major equipment did not need to be removed during transportation, it was then necessary to demobilize the modules and arrange them into the formation necessary to begin drilling operations.

BRIEF SUMMARY OF THE INVENTION

A mobile drilling system is provided which includes a plurality of drilling system modules capable of coordinated movement between well or other drilling sites. The mobile drilling system includes modules, such as a rig module, a power module and a pump module, which are initially positioned in a drilling formation or arrangement with respect to each other for the drilling of a first oil and gas well. After the completion of that well, the modules are then movable to a new location such as another well site. During the movement between the well sites, the drilling system modules are maintained in a formation which is substantially the same as the formation of the modules as used on the first drilling site. In order to accomplish this coordinated movement, each of the drilling system modules has wheel assemblies mounted therewith which are steerable, preferably simultaneously, in order to guide each of the modules during movement between well sites. Each of the modules further includes a propulsion system mounted with the module in order to drive the wheel assemblies attached to the modules in a predesignated direction and at a predesignated velocity, which can vary depending upon conditions. A steering system is in operative engagement with the propulsion system and the wheel assemblies of each module so that each module has a propulsion and steering system for moving the module between drilling sites. A position feedback system is mounted with each of the modules. The feedback position system includes sensors for detecting the relative position of each module with respect to the other modules during movement from the initial well site to subsequent drilling sites. The feedback position system cooperates with the propulsion system and the steering system in order to adjust the position of the modules with respect to each other to substantially maintain the initial drilling formation of the drilling system during such movement or travel between well sites.

One type of wheel assembly utilized is a dual or two-wheel assembly which is driven by the propulsion system and rotated or turned by the steering system. The wheel assembly includes one or more hydraulic motors or other types of motors to propel the rig at a predesignated or desired velocity. One of the wheels is turned or rotated by the steering system based upon feedback from the position feedback system, with the other wheel being in a mechanical, linked relationship to the first wheel so that both wheels rotate and move in unison. For heavier modules, multiple sets of four wheels are provided with driving motors and steering mechanism for moving the four-wheel assemblies into a particular direction as well as for driving the wheels at a desired velocity. It is within the scope of the invention to vary the number of wheels depending upon design and environmental conditions.

Using this structure, an operator is able to initially set up his rigs at a particular arrangement and thereafter continue that arrangement, including live connections for power and fluid transfer between the modules, during travel of the group of rig modules to a new location.

BRIEF DESCRIPTION OF THE SEVERAL VIEWS OF THE DRAWINGS

A better understanding of the present invention can be obtained when the following detailed description of the disclosed embodiments is considered in conjunction with the following drawings in which.

DETAILED DESCRIPTION OF THE PREFERRED EMBODIMENTS

The embodiments discussed herein are merely illustrative of specific manners in which to make and use the invention and are not to be interpreted as limiting the scope of the present invention.

While the invention is described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
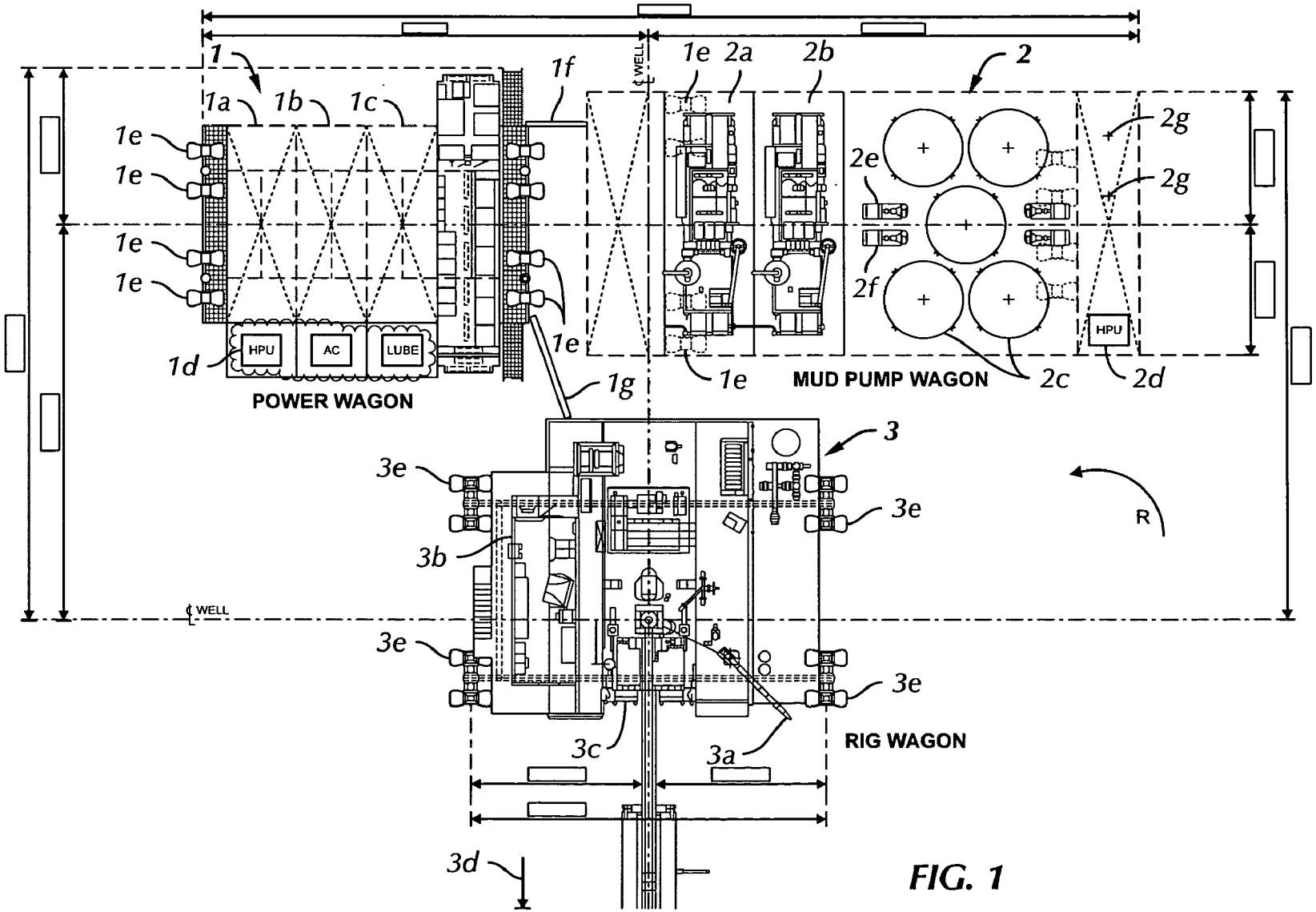
FIG. 1 illustrates a top view, partly in schematic, of a modular drilling rig of one embodiment of this invention.

Referring to the drawings in detail, FIG. 1 shows a top view of the drilling rig R of one embodiment of the present invention. The drilling rig R includes three self-propelled modules including a self-propelled power module or power wagon 1, a self-propelled mud pump module or mud pump wagon 2, and a self-propelled rig module or rig wagon 3. The embodiment illustrated in FIG. 1 shows a modular drilling rig that is capable of movement in formation from well to well while all modules remain completely interconnected and all power and systems remain intact and fully operational. The modules are self-propelled and do not require trucks, cranes, bull dozers, or other auxiliary rolling stock to move from well to well. The self-propelled rig module 3 includes, in one embodiment, four sets of quad (four wheels in each set) drive wheel assemblies 3*e* in general proximity to each corner or otherwise in a rectangular arrangement. The power module 1 and mud pump module 2 each include four sets of dual (two wheels) drive wheel assemblies 1*e* and 2*f* at each of their four corners or otherwise in a rectangular arrangement. The four sets of drive wheel assemblies may have any number of wheels that may be needed to support the load of the modules. For example, if the load in a particular module is very heavy, four or six wheels may be used for each wheel assembly.

In one embodiment of the present invention, each of the three drilling modules 1, 2 and 3, are self-propelled with the rig module being the master and the mud pump and power modules 1 and 2 being the slaves to the rig module 3.

In one embodiment of the present invention, the self-propelled power module 1 includes three generators, 1*a*, 1*b* and 1*c*, which generate electricity to drive various components of the drilling rig. The power module also includes a hydraulic power unit 1*d*, which provides the hydraulic power driving the rotation and turning of the wheel assemblies 1*e*. The cable booms 1*f* and 1*g*, harness the electrical and hydraulic cables from the power module 1 to the mud pump and rig modules 2 and 3. All cables and utilities stay intact and fully functioning during well-to-well transportation of the drilling rig.

In one embodiment of the present invention, the mud pump module 2 includes two mud pumps 2*a* and 2*b* and a plurality of round mud tanks 2*c*. The mud pump module 2 also includes a hydraulic power unit 2*d*, as well as centrifugal pumps 2*e* and 2*f*. The hydraulic power unit 2*d* provides hydraulic fluid which supplies power to the wheel assemblies for turning of the wheels of the wheel assemblies. It should be appreciated that any type of power may be used to power the turning of the wheels. For example, electric motors may be preferable to hydraulic power in some instances. The centrifugal pumps 2*e* and 2*f* provide for circulating and transferring mud from tank to tank and for transferring mud from the tanks to the mud pumps. Additionally, the mud pump module 2 includes a plurality of mixing hoppers 2*g* which mix the drilling fluid. The dual wheel drive assemblies 1*e* are at each of the four corners of the generally rectangular (as viewed in FIG. 1) mud pump module 2 in one embodiment of the present invention, but can also be positioned internally of the corners but in a rectangular arrangement. The cable boom 1*f* harnesses electrical, hydraulic, and fluid lines from the mud pump module 2 to the power module 1.

The rig module 3, in one embodiment, has four quad set drive wheel assemblies 3*e* wherein one quad set drive wheel assembly is located at each of the four corners of the rig module 3, which is generally rectangular as viewed in FIG. 1. The quad drive wheel assemblies 3*e* are utilized instead of the dual drive wheel assemblies 1*e* of the power module 1 and mud pump module 2, due to the typical heavier load of the rig module. If the load of the module is such that four wheels are insufficient, it should be appreciated that more wheels may be designed into the wheel assemblies. In one embodiment, the rig module also includes a utility crane 3*a*, a driller's cabin 3*b* and, and a pipe setback area 3*c*. Also included on the rig wagon 3 is a pipe handling system (not completely shown in FIG. 1). The pipe handling equipment may be located at one side of the rig module in the direction of the arrow 3*d*.

The wheel assemblies of each of the three modules 1, 2, and 3, each include fully load-equalized tires and are controlled by a control system extending from a control center on each wagon. The controls provide for coordinated turning of each wheel in the wheel assemblies and provide feedback of the relative position of the power and mud pump modules, 1 and 2, with respect to the rig module 3, so that the modules can be moved in formation and spatially coordinated. For example, during drilling of an initial well, the formation or spatial relationship of the power module 1, mud pump module 2 and rig module 3 is illustrated in FIG. 1, but it should be noted that the modules will have the ability to move independently as well as in formation.

Other mobile components of a drilling rig may include a headquarters trailer, a fuel trailer, a reserve mud tank, a water tank and a powered catwalk. These components are not illustrated in the drawings but may be moved via a truck, trailer, or self-propelled module.

Figure 2A:
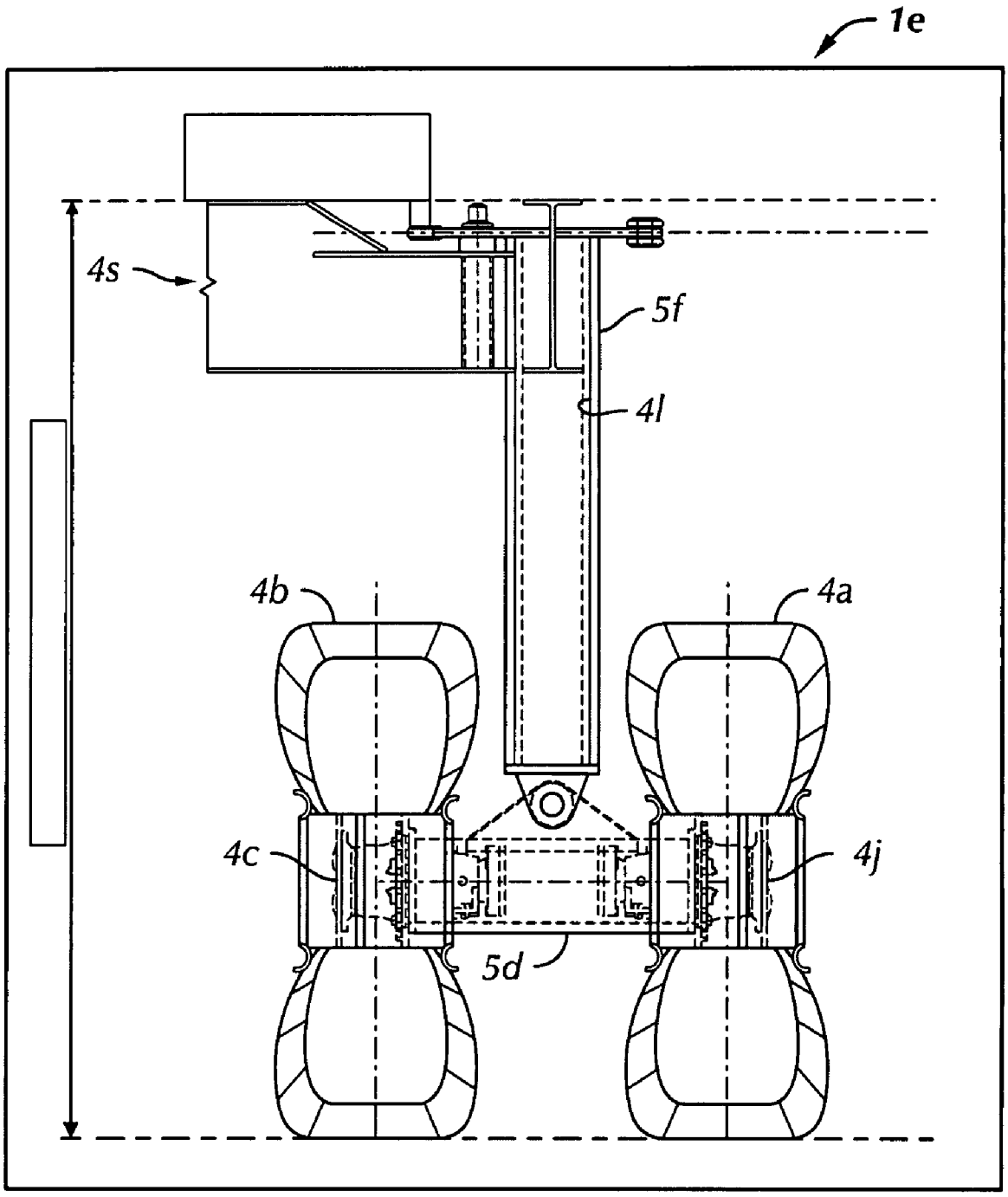
FIG. 2*a* illustrates an enlarged cross-sectional side view of the dual drive wheel assembly from either the power module or the mud pump module.
Figure 5:
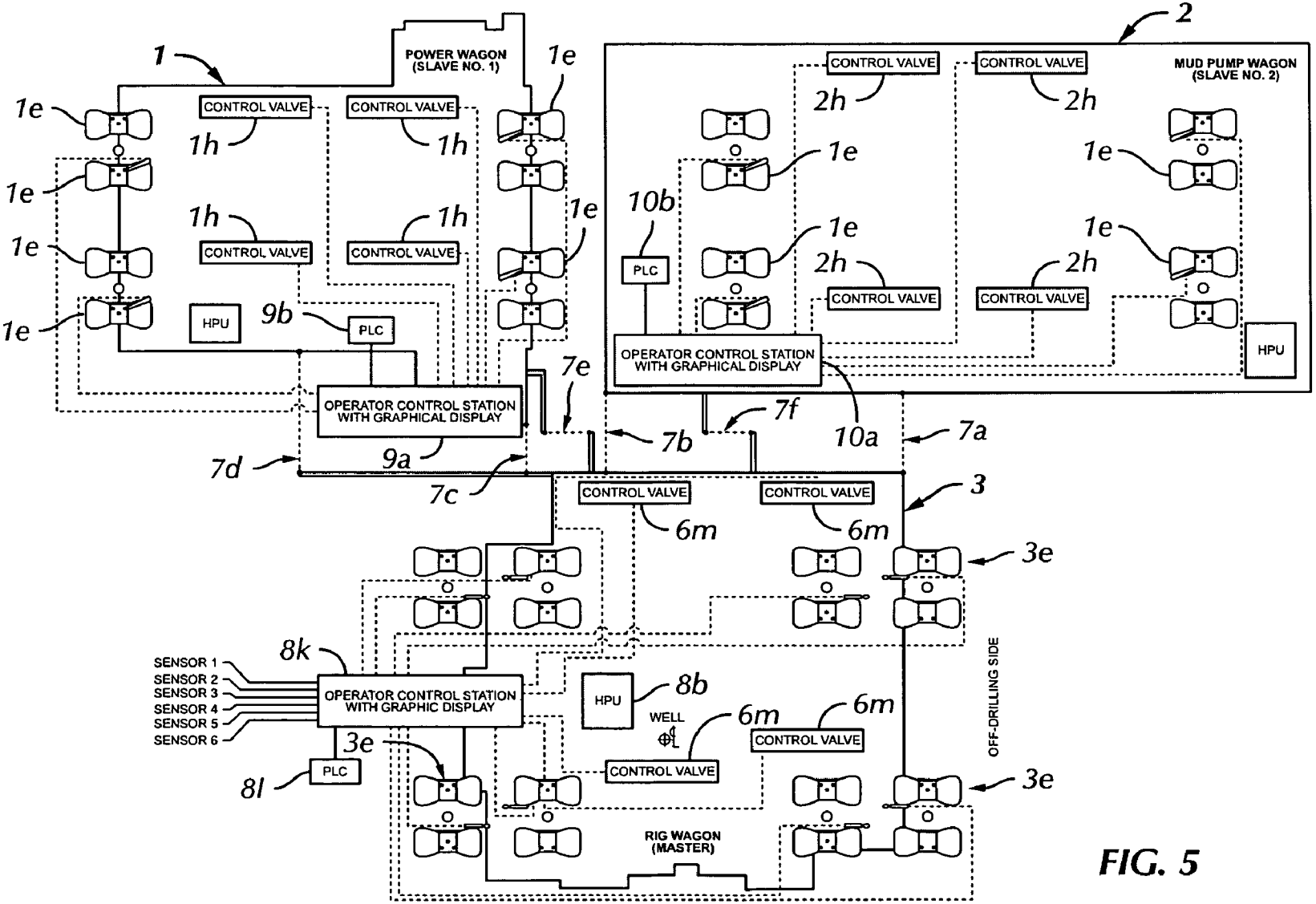
FIG. 5 illustrates a graphical illustration of the position feedback system.

FIG. 2*a* is an enlarged top view, partly in cross-section of the dual drive wheel assembly 1*c* utilized on both the power module 1 and the mud pump module 2 as contemplated in one embodiment of the present invention. Each of the dual drive wheel assemblies 1*e* includes two wheels 4*a* and 4*b*, two hydraulic wheel motors 4*c* and 4*j*, a steering linkage 4*d*, a steering knuckle 4*e*, a steering actuator arm 4*f*, a turning cylinder assembly 4*g*, and hydraulic fluid lines 4*h* and 4*m*, which power the steering and rotation of each dual drive wheel assembly 1*e*. The hydraulic lines 4*h* and 4*m* are controlled by a control valve 4*i* which is controlled by the hydraulic control system as depicted in FIG. 5. The propulsion system comprises the hydraulic lines such as 4*h* which provide propulsion to the hydraulic wheel motors 4*c* and 4*j* to rotate the wheels in either direction. The hydraulic lines 4*m* power the steering system by providing hydraulic power to the turning cylinder (hydraulic actuator) assembly 4*g*. It should be appreciated that other sources of power such as electrical power may be used to provide propulsion to the wheel motors and provide power to the steering system. The steering system is in operative engagement with the propulsion system.

Referring to FIG. 2*a*, an enlarged cross-sectional top view of the dual drive wheel assembly 1*e* of one embodiment of either the power module 1 or the mud pump module 2 is shown. The wheels 4*a* and 4*b* are shown in cross-section as are the hydraulic wheel motors 4*j* and 4*c*. In one embodiment, a common axle 5*d*, which is a cylindrical member, is fixedly connected to hydraulic wheel motors 4*c* and 4*j* of the dual wheel assembly 1*e*. Each of the hydraulic wheel motors 4*c* and 4*j* include a drive shaft which attaches to the internal hub of each wheel in order to import rotational movement of the wheels. Pivotally connected to the common axle 5*d* is a vertical cylindrical support or internal pipe member 4*l* mounted for rotational movement with respect to a static vertical support 5*f*, which is attached to the rig frame portion 4*s*. Vertical support 4*l*, which is mounted within the vertical support 5*f*, is rotated by the steering knuckle 4*e*, in order to turn the second wheel 4*b*.

Figure 2B:
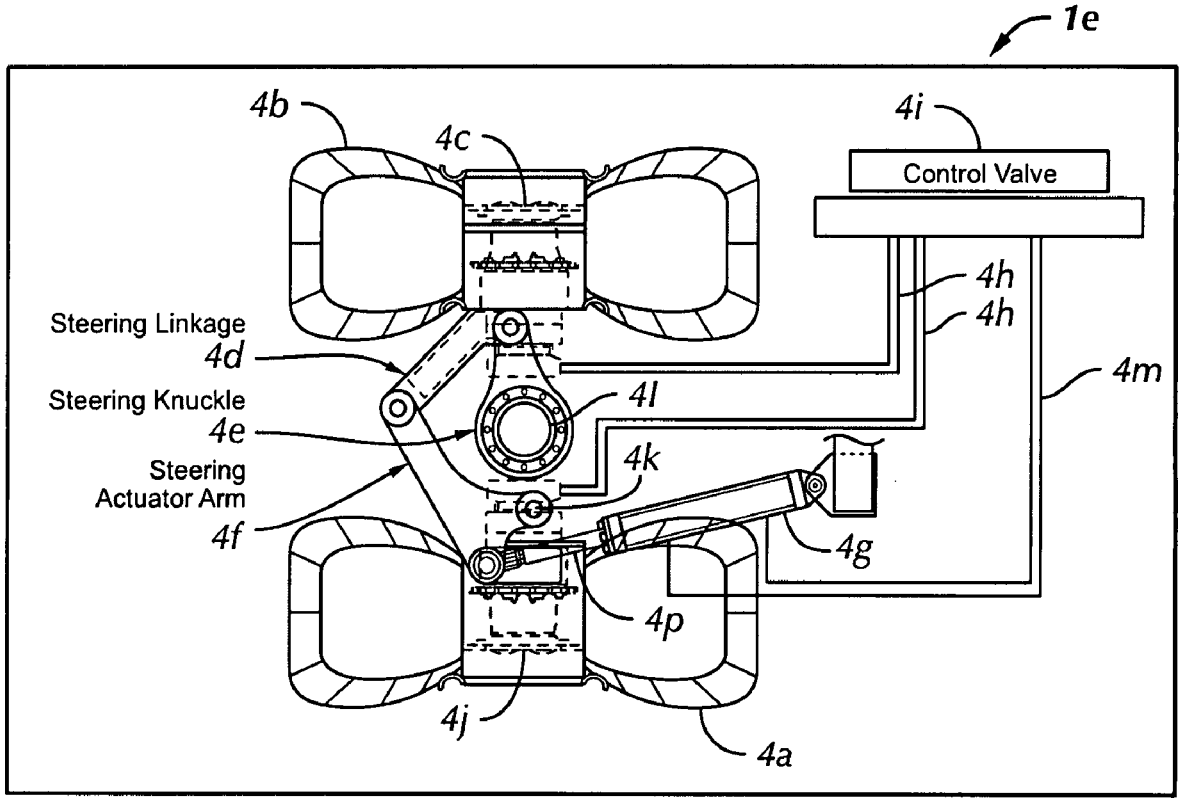
FIG. 2*b* illustrates an enlarged cross-sectional top view of the dual drive wheel assembly from either the power module or mud pump module.

In operation, each dual drive wheel assembly 1*e*, in one preferred embodiment, operates via hydraulic pressure communicated to the turning cylinder assembly 4*g* and the hydraulic wheel motors 4*c* and 4*j* in order to turn and rotate the wheels 4*a* and 4*b*. In order to turn the wheels 4*a* and 4*b* to the right (toward top of FIG. 2), the control valve 4*i* supplies hydraulic pressure, via the hydraulic line 4*m*, to the turning cylinder assembly 4*g* to extend the piston rod 4*p* of the turning cylinder assembly 4*g*. This will cause the steering actuator arm 4*f*, which is pivotally mounted to the rig frame (designated as 4*s* in FIG. 2*b*) and the steering linkage 4*d* (which connects the wheels 4*a* and 4*b*), which is mounted for pivotal movement to steering actuator arm 4*f* and to steering knuckle 4*e*, to rotate, thereby causing the steering knuckle 4*e* to rotate, and hence cause the wheel assembly 1*e* to turn in order to effect turning of the module. Rotation of the steering knuckle 4*e* causes the second wheel 4*b* to turn in conjunction with the first wheel 4*a*. The steering knuckle 4*e* is fixedly attached to the vertical support 4*l*, which is a cylindrical or pipe member mounted for rotational movement in a generally vertical axis, with external vertical support or pipe member 5*f*, which is fixedly attached to the rig frame 4*f*.

Figure 3:
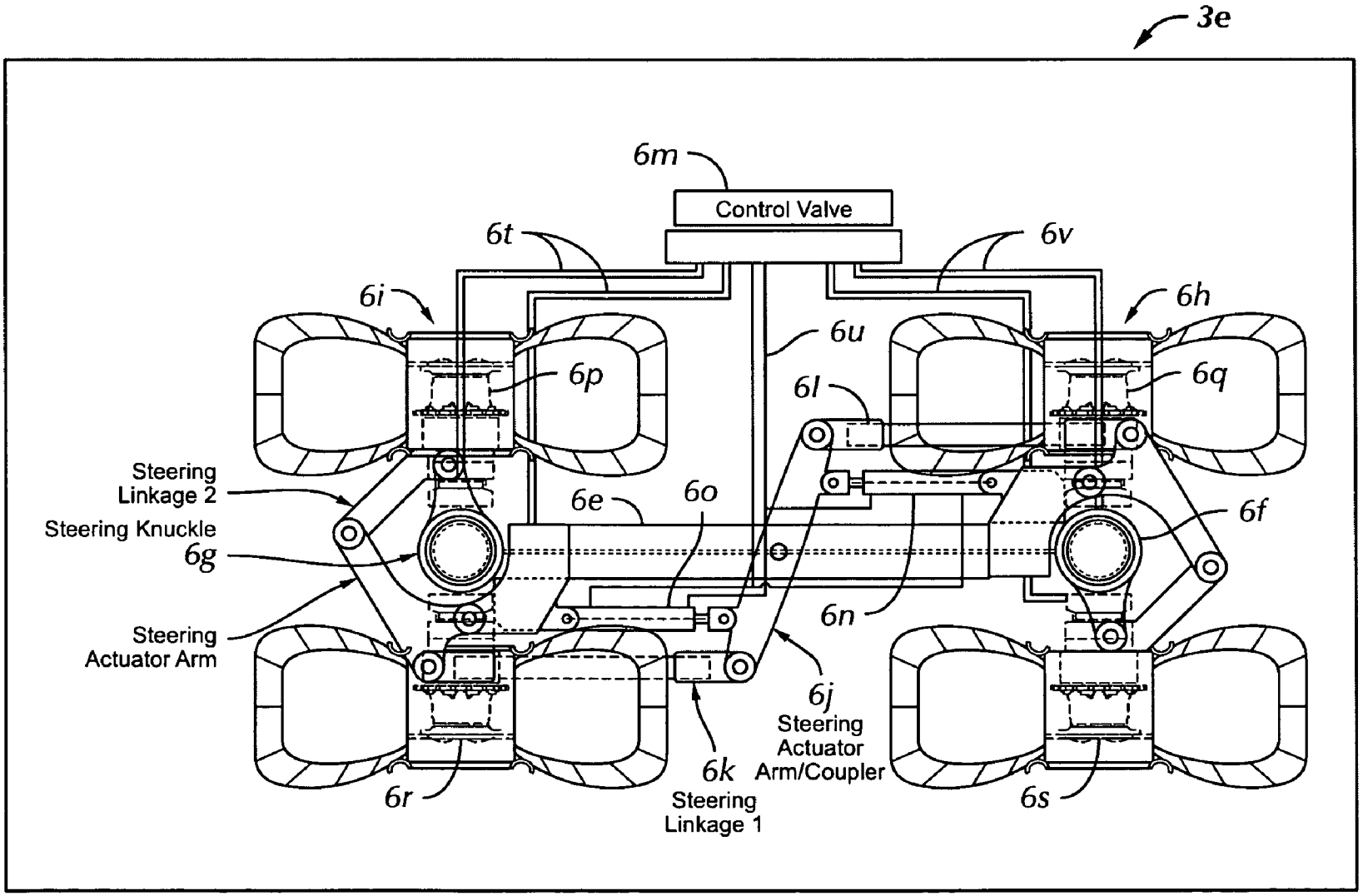
FIG. 3 illustrates a cross-sectional top view of a quad set of drive wheel assemblies from the rig module.

FIG. 3 illustrates a cross-sectional enlarged top view of the quad drive wheel assemblies 3*e* from the rig module 3, with a schematic of the various hydraulic lines and controls. The quad set 3*e* is comprised of two interconnected dual sets of wheel assemblies 6*h* and 6*i* with a walking beam 6*e* rigidly interconnecting the steering knuckles 6*f* and 6*g* of each dual set of wheels 6*h* and 6*i*. The dual sets 6*h* and 6*i* are in synchronous movement with one another due to mechanical linkage comprising the walking beam 6*e* and the steering actuator arm 6*j* which is pivotally connected to the walking beam 6*e* and pivotally connected to two corresponding steering linkages 6*k* and 6*l* of the dual sets 6*h* and 6*i* respectively. As with the dual drive wheel assemblies, the quad set drive wheel assembly 3*e* is operated via the propulsion system. The control valve 6*m* supplies hydraulic power through hydraulic lines 6*u* to the turning cylinders 6*n* and 6*o* as well as the hydraulic wheel motors 6*p*, 6*q*, 6*r*, and 6*s* through hydraulic lines 6*t* and 6*v*. The control valve 6*m* for each quad set of wheel assemblies 3*e* communicates via the hydraulic lines to the turning cylinder assemblies 6*n* and 6*o* and the hydraulic wheel motors 6*p*, 6*q*, 6*r* and 6*s* in order to rotate the wheels or turn the wheel assemblies. The hydraulic lines, 6*t* provide hydraulic propulsion to the wheel motors 6*r* and 6*p*. The hydraulic lines 6*u* provide hydraulic fluid to the turning cylinder assemblies 6*n* and 6*o* in order to turn the wheel assembly 6*i*. Finally, hydraulic line 6*v* provides hydraulic propulsion to the wheel motors 6*q* and 6*s*.

Figure 4A:
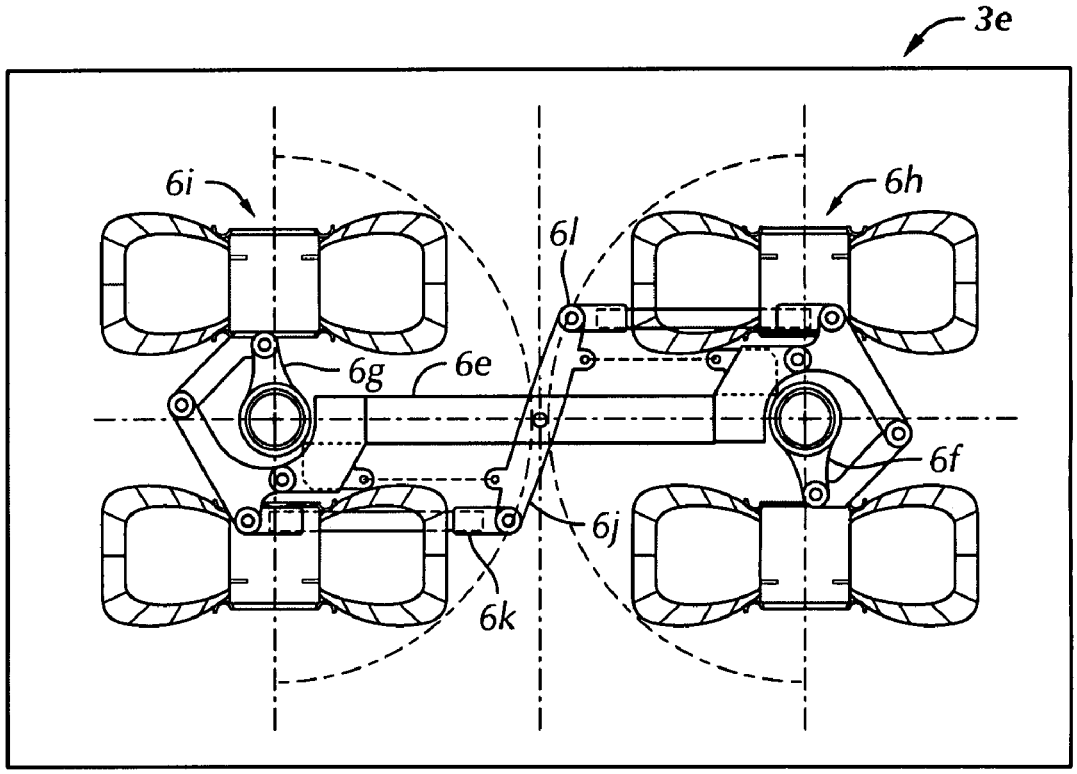
FIG. 4*a* illustrates a cross-sectional top view of a quad set of drive wheel assemblies from the rig module.
Figure 4B:
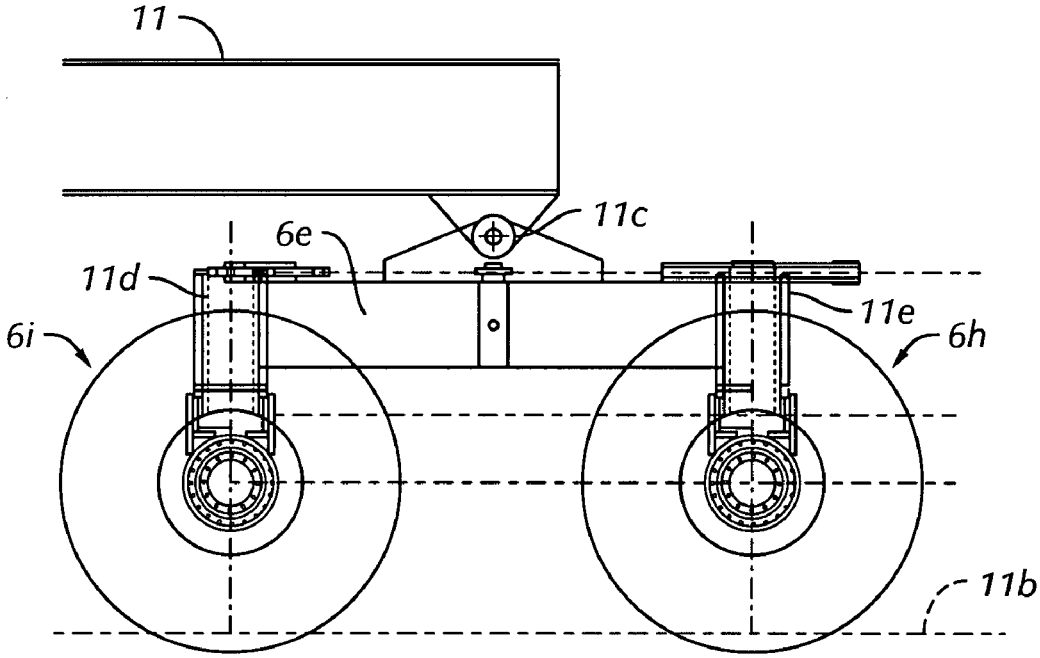
FIG. 4*b* illustrates a cross-sectional side view of a quad set of drive wheel assemblies from the rig module.

FIG. 4*a* illustrates a cross-sectional enlarged top view partly in schematic of the quad set of drive wheel assemblies 3*e* from the rig module 3. The quad set 3*e* is comprised of two interconnected dual sets or assemblies of wheels 6*h* and 6*i* which are driven by hydraulic motors (6*p*, 6*q*, 6*r* and 6*s* in FIG. 3) in the same manner as the wheels 4*a* and 4*b* are driven by hydraulic motors 4*c* and 4*j* as shown in FIG. 2*a*. Further, each dual sets of wheels 6*h* and 6*i* are interconnected by an axle 5*d* (FIG. 2*a*) which is mounted for pivotal movement (about a generally vertical axis) to internal cylindrical support 4*l* (shown but unnumbered in FIGS. 3 and 4*a*). Referring to FIG. 4*b*, the walking beam 6*e* extends and is attached to each of the external vertical pipe supports 11*d* and 11*e*, which are attached to the rig frame schematically designated at 11. The walking beam 6*e* is mounted for pivotal movement by pivotal clevis connection 11*c* to the frame 11 such that the sets of dual wheels are movable about a horizontal axis. The dual sets 6*h* and 6*i* are movable in synchronous movement with one another due to the mechanical linkage comprising the walking beam 6*e* and the steering actuator arm 6*j* which is pivotally connected to the walking beam 6*e* and pivotally connected to two corresponding steering linkages 6*k* and 6*l* of the dual sets 6*h* and 6*i* respectively.

FIG. 4*b* illustrates a cross-sectional enlarged side view of the quad set of drive wheel assemblies 3*e* from the rig module 3. The walking beam 6*e* interconnects the first and second wheel assemblies 6*h* and 6*i*. The walking beam 6*e* is pivotally connected (about pivot point 11*c*) to the frame 11 for pivotal movement about a horizontal axis 11*a*. The wheel assembly is also pivotally connected to the frame 11 for pivotal movement about the clevis, another horizontal axis (in the plane of movement of the tires moving vertically, not shown). The two pivot points about horizontal axes serve to ensure that all four tires are always touching the ground 11*b* even if the ground 11*b* is uneven.

FIG. 5 illustrates a graphical representation of the position feedback system generally designated as 7 which controls the coordinated movement of each of the self-propelled rig modules 1, 2 and 3. The rig module 3 contains a hydraulic power unit 8*b* which provides hydraulic fluid to the hydraulic wheel motors and turning cylinders of the quad set of wheel assemblies 3*e*. The control valves 6*m* communicate via hydraulic lines to the wheel assemblies 3*e*. The operator control station 8*k* includes a graphical display which displays to the operator the conditions and positions of each of the wheel assemblies. Control valves 1*h* are located on power rig 1 in order to control the propulsion and turning of the wheel assemblies 1*e* (see FIG. 2A-B). Similarly, control valves 2*h* on mud module 2 control the propulsion and turning of dual wheel assemblies 1*e* positioned in a generally rectangular configuration under rig 2. Within the operator control station 8*k* is a programmable logic controller 8*l* which receives data from linear position sensors 7*a*, 7*b*, 7*c*, 7*d*, 7*e* and 7*f* about the location of the power module 1 and mud pump module 2 in relation to the rig module 3. The linear positioning sensors may be any type known by a person of ordinary skill in the art, such as a laser or an encoder reel. An encoder reel uses a string, rope or wire wrapped around a reel and calculates position based on number of rotations of the reel and diameter of the reel. Each of the three self-propelling modules 1, 2 and 3 have their own operational control station and hydraulic power unit.

In operation, an operator controls the movement of the rig module 3 via a joystick or some other steering or control mechanism (not shown). Position information from the feedback sensor system 7*a*-7*f* is communicated to programmable logic chip or other computer element to compute the relative position of each of rigs 1-3, which information is provided to the operator control station 8*k* which sends feedback signals to each of the control valves 6*m* on rig 3, as well as to control valves 1*h* on rig 1 and control valves 2*h* on rig 2. The operator control station 8*k* sends feedback signals to each of the drive wheel assemblies 3*e* through these various control valves to modify the relative position of each rig with respect to the other rigs in order for the formation of the modules to remain substantially unchanged, such as from the arrangement of the modules during drilling of an earlier well, during travel to a new well site. For example, in one preferred embodiment, if the operator desires to make a right-hand turn, the operator control station 8*k* sends a signal to each of the control valves of each rig in order to send hydraulic pressure to each of the corresponding turning cylinders (not shown) within the drive assemblies (see FIGS. 2*a*, 2*b* and FIG. 3). The operator may also wish to slow down or speed up the movement of the rig module 3 relative modules 1 and 2. To accomplish this, the operator sends a signal to the operator control station 8*k* which sends a hydraulic signal to each of the control valves of each rig which sends a hydraulic signal to each of the hydraulic wheel motors driving the wheel assemblies on each rig.

It should be noted that the steering controls utilized in conjunction with the dual wheel assemblies 1*e* and the quad wheel assemblies 3*e* enable all the wheels to be turned in the same direction substantially simultaneously, such that subsequent driving or propulsion of the turned wheels provides for crab-like or angled movement of these giant pieces of equipment.

The linear position sensors 7*a*, 7*b*, 7*c*, 7*d*, 7*e*, and 7*f* sense the position of each of the power and mud pump modules 1 and 2 in reference to the rig module 3. Signals from these linear position sensors are sent to the operator control stations 8*k*, 9*a*, and 10*a* of each of the modules. The programmable logic controllers 8*l*, 9*b*, 10*b* then calculate the actions within each of the power module 1 and mud pump module 2 that must be completed in order for these modules to travel in formation or predesignated spatial position with the travel of the rig module 3.

For example, in one preferred embodiment, if the operator desires to turn the three self-propelled modules to the right, the rig operator will instruct the rig module 3 to make a right-hand turn and a signal will be sent to the operator control station 8*k*, which sends a hydraulic signal to each of the control valves 6*m*, which sends a hydraulic signal to each of the four quad sets of drive wheel assemblies 3*e*. The piston rods of the turning cylinder assemblies (not shown) within the four quad sets of drive wheel assemblies 3*e* will expand in order to rotate or turn each of the wheel sets. The linear position sensors 7*a*, 7*b*, 7*c*, 7*d*, 7*e* and 7*f* will sense if the rig module 3 has changed position moved in reference to the power module 1 and the mud pump module 2. The position sensors will send a signal to the operator control stations 8*k*, 9*a*, and 10*a* and the programmable logic controllers 9*b* and 10*b* will calculate the actions needed to propel and turn the wheel assemblies in the power module 1 and the mud pump module 2 and rig module 3 to maintain the desired formation. Any adjustment to position of each of the rigs may be accomplished automatically utilizing the feedback, propulsion and steering systems, or each operator on each rig may be notified of positional changes to be made on his or her rig such that position adjustment can be accomplished from each rig.

In another embodiment of the present invention, a string or rope will be stretched from the starting location of the rig module 1 to an ending location of that module, which may be the next well site. A camera may be used to monitor the module's location in reference to the string or rope. A monitor may be mounted in the operators' cabin so that the operator can monitor the module's location in reference to the string or rope and make the necessary adjustments. As the operation of the rig wagon 1 moves the rig wagon in the direction of the guide rope, the feedback system, utilizing the positional information derived from the sensors 7*a*-*f*, will automatically adjust the speed and position of the power wagon and mud wagon 2 with respect to the rig wagon and each other. The formation of the Rigs 1-3 during movement to a subsequent well site may be substantially the same formation of the rigs 1-3 while drilling the initial well, or any other formation which efficiently allows to rig set-up upon arrival at the next well site. Further, the traveling formation may be designed with an adjustable margin of error in relative positions of the rigs 1-3. For example, the feedback control can be adjusted to allow a predesignated amount of latitude or variation from a designated formation, or arrangement of the rigs. While the position feedback system disclosed utilizes a series of sensors mounted on each of the three rigs to be moved in unison, other feedback systems may be used such as gps (global position satellite) to monitor the relative positions, arrangement or formation of the rigs 1-3 with respect to each other.

While it is a significant advantage to move the well modules in formation, there may be circumstances where it is desirous to move each module 1-3 independently of the other rig modules. For example, if there is a well site location with a plurality of wells and then another well site location with another plurality of wells several miles away from the first plurality of wells, the operator may desire to move each of the modules independently of the others due to obstructions or other operational concerns; and, in that situation, the feedback control system is temporarily deactivated, but can be restarted when it is designed to re-position the rig modules in formation.

We claim:

1. A mobile drilling system which includes a plurality of modules capable of coordinated movement between well or other drilling sites, comprising:

(a) a plurality of drilling system modules positioned in a drilling formation with respect to each other during drilling of a first oil or gas well;

(b) each of said drilling system modules having wheel assemblies mounted therewith which are steerable in order to guide each of said modules during said movement from said initial well to subsequent drilling sites;

(c) each of said drilling system modules having a propulsion system mounted therewith in order to drive said wheel assemblies of each of said modules at directed velocities during said movement between said well or other drilling sites;

(d) each of said drilling system modules having a steering system in operative engagement with said propulsion system and said wheel assemblies of each of said modules such that each module has a propulsion and steering system for moving said module between said well or other drilling sites; and, (e) a position feedback system mounted with each drilling system module, each of said position feedback systems including sensors for detecting the relative position of each module with respect to the other modules during movement from said initial well to subsequent drilling sites, said feedback system of at least one of said modules providing feedback to said propulsion and/or steering systems of said other modules in order to adjust the position of said modules with respect to each other in order to substantially maintain the initial drilling formation of said drilling system modules during movement from said initial well to other drilling sites.

2. The mobile drilling system of claim 1, further comprising:

(a) said sensors on at least two of said modules interacting with said sensors on a third module in order to provide feedback of the relative position of said three modules with respect to each other, said feedback mechanism cooperating with said propulsion and steering systems in order to adjust the velocity and direction of said wheel assemblies in order to substantially maintain said three modules in said initial drilling formation during movement to a subsequent drilling site.

3. The mobile drilling system of claim 1, further comprising:

(a) said plurality of drilling system modules including a master and at least two slave drilling modules positioned in said drilling formation with respect to each other during drilling of a first oil or gas well; and, (b) said sensors on said master and each of said two slave modules interacting with the remainder of said position feedback system to determine the relative position of each slave module with respect to said master module such that said master and at least two slave modules are moved in formation with their initial drilling positions remaining substantially unchanged during movement between said well to other drilling sites.

4. The mobile drilling system of claim 3, further comprising:

(a) said position feedback system mounted with said master module and providing information to said propulsion system and steering system of the position of each of said slave modules with respect to said master module.

5. The mobile drilling system of claim 1, further comprising:

(a) each of said drilling system modules having a generally rectangular frame in plan view with at least four corners;

(b) at least one of said wheel assemblies being mounted with said rectangular frame of each module in proximity of each of said four corners or in other rectangular arrangement.

6. The mobile drilling system of claim 5, further comprising:

(a) each of said wheel assemblies being mounted to said frame of each drilling system module for turning movement about a generally vertical support;

(b) each of said wheel assemblies including at least two wheels which are mechanically interconnected to each other and to said generally vertical support for pivotal movement about a generally horizontal axis;

(c) said propulsion system including a driving motor operably engaging at least one of said wheels for driving said wheels;

(d) said steering system including a hydraulic actuator extending between said frame of each module and at least one of said wheels for turning said wheel in a particular direction; and (e) a steering linkage mechanically interconnecting said first and second wheels for turning said wheels simultaneously in said particular direction.

7. The mobile drilling system of claim 6, further including:

(a) said propulsion system including said first-mentioned driving motor operably engaging said first wheel and a second driving motor operably engaging said second wheel.

8. The mobile drilling system of claim 5, further comprising:

(a) at least one of said first-mentioned wheel assemblies interconnected with a second wheel assembly which are mounted with said rectangular frame of at least one module, each of said first and second interconnected wheel assemblies having at least first and second wheels;

(b) each of said first and second interconnected wheel assemblies being mounted to said frame for turning movement about a generally vertical axis;

(c) each of said first and second interconnected wheel assemblies being interconnected by a beam member mounted to said frame for pivotal movement in a first horizontal axis;

(d) said first and second wheels of each of said wheel assemblies being mechanically interconnected for pivotal movement about a second horizontal axis;

(e) said propulsion system including a driving motor operably engaging at least one of said wheels of each of said first and second interconnected wheel assemblies for driving said wheels;

(e) said steering system including a hydraulic actuator extending between said frame of each module and at least one of said wheels of each of said interconnected first and second wheel assemblies for turning said wheels in a particular direction;

(f) a steering linkage mechanically interconnecting said two wheels of each of said first and second wheel assemblies for turning said wheels simultaneously in said particular direction; and, (g) a quad steering linkage mechanically interconnecting said first and second wheel assemblies to turn said wheels in each of said first and second wheel assemblies in the same direction.

9. Mobile drilling system which includes a plurality of modules capable of coordinated movement between well or other drilling sites, comprising:

(a) first, second and third drilling system modules being in an initial spatial formation or arrangement for drilling a first well;

(b) each of said first, second and third drilling system modules having wheel assemblies mounted therewith which are steerable in order to guide said modules during said movement from said first well to other drilling sites;

(c) each of said first, second and third drilling system modules having a propulsion system mounted therewith in driving engagement with said wheel assemblies of said module in order to drive each of said modules during said movement from said first well to other drilling sites;

(d) each of said drilling system modules having a steering system in operative engagement with said propulsion system and said wheel assemblies of each of said modules such that each module has a separate propulsion and steering system for driving and steering each of said wheel assemblies on each module; and, (e) a position feedback system mounted with each drilling system module, each of said position feedback systems including sensors for detecting the relative position of each of said first, second, and third modules with respect to each other during movement, and providing feedback to each propulsion system and steering control system of each module in order to move said modules into another well site while maintaining said modules in substantially the formation of the modules while used for drilling at the initial well site.

10. The mobile drilling system of claim 9, in which said feedback system for each of said first, second, and third modules further comprises:

(a) said sensors on said second and third drilling system modules interacting with said sensors on said first module in order to provide positional feedback of the position of each of said second and third modules with respect to said first module in order to maintain said modules in substantially the formation of said module while used for drilling at the initial well site during movement to another drill site.

11. The mobile drilling system of claim 9, further comprising:

(a) said first, second, and third drilling system modules including a master and at least two slave drilling system modules having said sensors mounted therewith; and, (b) said sensors on said master and each of said two slave modules interacting with the remainder of said position feedback system to determine the relative position of each slave module with respect to said master module such that said feedback system cooperates with said propulsion and steering systems to automatically maintain said master and two slave modules in substantially the formation of the modules while used for drilling at said initial well site.

12. The mobile drilling system of claim 9, wherein each wheel assembly further comprises:

(a) each of said drilling system modules having a first vertical support extending downwardly from said module, said first vertical support having a second vertical support mounted for rotational movement with respect to said first vertical support;

(b) first and second wheels having a common axle;

(c) said common axle being pivotally attached to said second vertical support for pivotal movement about a horizontal axis;

(d) a first hydraulic motor of said propulsion system mounted with said common axle and said first wheel and a second hydraulic motor of said propulsion system mounted with said common axle and said second wheel for driving said first and second wheels; and (e) said steering mechanism including a turning mechanism for rotating said second vertical support, said common axle and said first and second wheels for turning said wheels in a particular direction.

13. The mobile drilling system of claim 12, further including:

(a) a second wheel assembly having third and fourth wheels;

(b) a walking beam mounting said first and second wheel assemblies for pivotal movement about a horizontal axis;

(c) each of said drilling system modules having a third vertical support extending downwardly from said module, said third vertical support having a fourth vertical support mounted for rotational movement with respect to said third vertical support;

(d) said third and fourth wheels having a second common axle;

(e) said second common axle being pivotally attached to said fourth vertical support for pivotal movement about a horizontal axis;

(f) a third hydraulic motor of said propulsion system mounted with said second common axle and said third wheel and a fourth hydraulic motor of said propulsion system mounted with said second common axle and said fourth wheel for driving said third and fourth wheels; and (g) said steering system including a second turning mechanism for rotating said fourth vertical support, said second common axle and said third and fourth wheels for turning said wheels in a particular direction.

14. The mobile drilling system of claim 13, further including:

(a) a linkage extending between said first and second wheel assemblies and into operative engagement with said first and second turning mechanisms whereby said first, second, third, and fourth wheels are turned simultaneously in a particular direction.

15. The mobile drilling system of claim 12, further comprising:

(a) said position feedback system of each module coacting with said propulsion and steering system of each module to control said first and second hydraulic motors and said turning mechanism in order to adjust the velocity and turning direction of said wheels.

16. A method for coordinating movement of a mobile drilling system between well or other drilling sites, which includes a plurality of modules comprising the steps of:

(a) providing a plurality of drilling system modules positioned in a drilling formation with respect to each other during drilling of a first oil or gas well;

(b) providing said drilling system modules with wheel assemblies;

(c) providing said drilling system modules with a propulsion system;

(d) providing said drilling system modules with a steering system to cooperate with said propulsion system and said wheel assemblies such that each module is moveable and steerable for moving said module between said well or other drilling sites; and, (e) providing a position feedback system with sensors for detecting the relative position of each module with respect to the other modules during movement from said initial well to subsequent drilling sites, providing feedback to said propulsion and/or steering systems of said other modules in order to adjust the position of said modules with respect to each other in order to substantially maintain the initial drilling formation of said drilling system modules during movement from said initial well to other drilling sites.

17. The method of claim 16, further comprising the steps of:

(a) interacting said sensors on at least two of said modules with said sensors on a third module in order to provide feedback of the relative position of said three modules with respect to each other, using said feedback in cooperation with said propulsion and steering systems in order to adjust the velocity and direction of said wheel assemblies in order to substantially maintain said three modules in said initial drilling formation during movement to a subsequent drilling site.

18. The method of claim 16, further comprising the steps of:

(a) providing said plurality of drilling system modules including a master and at least two slave drilling modules and positioning said module in said drilling formation with respect to each other during drilling of a first oil or gas well; and, (b) interacting said sensors on said master and each of said two slave modules to determine the relative position of each slave module with respect to said master module, and moving said master and at least two slave modules to other drilling sites in the formation of their initial drilling positions.

* * * * *